US007147493B1

(12) United States Patent
Mahoney

(10) Patent No.: US 7,147,493 B1
(45) Date of Patent: Dec. 12, 2006

(54) CONNECTOR FOR AN IGNITER CABLE

(75) Inventor: Errol D. Mahoney, Jupiter, FL (US)

(73) Assignee: The BG Service Co., Inc, West Palm Beach, FL (US)

( * ) Notice: Subject to any disclaimer, the term of this patent is extended or adjusted under 35 U.S.C. 154(b) by 0 days.

(21) Appl. No.: 11/209,130

(22) Filed: Aug. 22, 2005

(51) Int. Cl.
*H01R 13/44* (2006.01)

(52) U.S. Cl. ..... 439/125

(58) Field of Classification Search ..... 439/125, 439/296, 357–358, 327–328, 126; 123/633, 123/169 PH
See application file for complete search history.

(56) References Cited

U.S. PATENT DOCUMENTS 3,965,879 A * 6/1976 Fitzner ..... 123/633
4,145,106 A * 3/1979 Livingston ..... 439/126
5,666,453 A * 9/1997 Dannenmann ..... 385/101
6,358,072 B1 * 3/2002 Johnson ..... 439/126

* cited by examiner

*Primary Examiner*—J. F. Duverne
(74) *Attorney, Agent, or Firm*—Norman Friedland

(57) ABSTRACT

A connector within an igniter cable, configured for attachment to the high voltage terminal of an exciter, includes a contact terminal attached to the wire within the cable, having a number of flexible contact members to engage a pin within the high voltage terminal, and a latching sleeve, with the contact terminal and the latching sleeve being installed from opposite ends of an insulating tube. Flexible latching members of the latching sleeve engage a latching surface of the contact terminal to prevent inward movement of the contact terminal within the insulating tube when the pin within the high voltage terminal is engaged.

15 Claims, 2 Drawing Sheets

CONNECTOR FOR AN IGNITER CABLE

BACKGROUND OF THE INVENTION

1. Field of the Invention

This invention relates to electrical connections, and, more particularly, to a connection between an aircraft igniter cable and the exciter driving the igniter.

2. Summary of the Background Art

An aircraft turbine engine is typically provided with two igniter plugs, located in separate combustion chambers, which are used to start the engine, and, in the event of a flame-out, to restart the engine. A typical ignition system for an aircraft turbine engine includes an electrical power source, two igniter plugs, separate exciters for the two igniter plugs, and associated wiring with igniter cables forming high tension leads. Normally, the electrical current driving the igniter is supplied only for a short time when the engine is started.

Each of the exciters converts low voltage alternating or direct current into a high voltage used to drive the associated igniter plug. For example, within the exciter, a 400-Hz alternating current at a low voltage is driven through a primary winding of a power transformer to be transformed into a higher voltage at the secondary winding of the transformer. This higher voltage is then applied to a voltage doubler circuit including a pair of solid state rectifiers and a pair of capacitors. The output of the voltage doubler circuit is applied across the terminals of a storage capacitor, so that with each change in polarity of the alternating current, a pulse of direct current is driven into the storage capacitor, which then assumes an ever increasing charge and voltage level with successive pulses. The high voltage terminal of the storage capacitor is connected to an input of a discharge tube, so that, when the voltage of the storage capacitor reaches a predetermined level of about 3000 volts, the spark gap within the discharge tube breaks down, causing a portion of the charge accumulated within the storage capacitor to flow through the primary winding of a high-tension transformer. The output coil of the high-tension transformer is connected to the igniter plug through a high-voltage output terminal of the exciter and through the igniter cable. When the charge accumulated in the storage capacitor flows through the input coil of the high-tension transformer, a voltage established within the output coil of this transformer causes air within the air gap of the igniter plug to ionize at approximately 26,000 volts, making the gap conductive, so that the remaining electrical charge produces a high current, low voltage spark across the gap. Thus, the connection between the exciter and igniter cable must withstand the application of a voltage over about 26,000 volts to the conductors within the connection, so that current does not flow between these conductors and nearby grounded surfaces, and must additionally be capable of carrying a high current to sustain the spark within the igniter plug gap.

FIG. 1 is an exploded, partly sectional, elevation of elements forming a first version 10 of a conventional connector at an end of an igniter cable for attachment of the cable to the high voltage output terminal of an exciter. The connector 10 includes a terminal 12 crimped in place over the conductor 14 within a wire 16, together with a contact sleeve 18 that is crimped over a sleeve receiving section 20 of the terminal 12. The contact sleeve 18 includes one or more cantilever spring members 22 that are formed inward to make contact with a rounded pin (not shown) within the high voltage terminal of the exciter. The connector 10 additionally includes an insulating sleeve 24 pulled over the contact sleeve 18, the terminal 12, and the end of the wire 16.

When the connector 10 is attached to the high voltage output terminal of the igniter, an axial engagement force pushing the contact sleeve 18 in the direction of arrow 26 is established by contact between the rounded pin within the output terminal and the spring members 22 of the contact sleeve 18. The crimped connection between the contact sleeve 18 and the terminal 12 must be strong enough to resist this axial engagement force, and the assembly including the contact sleeve 18, the terminal 12, and the wire 16 must be held tightly enough within the insulating sleeve 24 to prevent the movement of this assembly in the direction of arrow 26 within the insulating sleeve 24 due to this axial engagement force. Meeting these requirements has resulted in a connector configuration that is often too long to fit within the distance available between the high voltage output terminal of an exciter and an igniter plug without coiling or curving the igniter cable backward to fit on the igniter plug. Thus, what is needed is an igniter cable connector having a robust connection between flexible contact members and the conductor within the wire in a shorter space.

FIG. 2 is an exploded, partly sectional, elevation of elements forming a second version 30 of a conventional connector at an end of an igniter cable for attachment of the cable to the high voltage output terminal of an exciter. The connector 30 includes a terminal 32 crimped in place over the conductor 34 within a wire 36. The terminal 32 includes one or more cantilever spring members 38 and a retaining slot 40. After an insulating sleeve 42 is installed over the terminal 32 and the end of the wire 36, a retaining clip 44, in the form of a snap ring, is snapped into place within the retaining slot 40. This retaining clip 44, through contact with a wall surface 46 of a cavity 48 at an end of the insulating sleeve 42, prevents movement of the terminal 32 in the direction of arrow 50 within the insulating sleeve 42 as the connector 30 is attached to the high voltage output terminal of an exciter, with the cantilever spring members 38 moving in contact with the rounded pin (not shown) within the output terminal.

While the second version 30 of a conventional connector is shorter in length than the first version 10, the retaining clip 44 may become loose due to vibration and may break or fall off when the connector 30 is removed from the high voltage output terminal of the exciter during a maintenance procedure. Such a small part may present a hazard if it is not noticed or otherwise lost within the engine compartment during maintenance. Therefore, what is needed is connector occupying a short space while requiring the use of a retaining clip to be held in place within an insulating sleeve.

SUMMARY OF THE INVENTION

In accordance with one aspect of the invention, a connector is provided for attachment at an end of a cable. The connector includes a contact terminal, an insulating tube, and a latching sleeve. The contact terminal includes a wire receiving cavity at its distal end for receiving an end of a conductor in a wire within the cable, at least one flexible contact member disposed to engage a terminal pin inserted into the contact terminal from its proximal end, and a latching surface at its distal end. The insulating tube includes a terminal receiving cavity extending between its proximal and distal ends for receiving the contact terminal attached to the end of the conductor in the wire within the cable, with the contact terminal being inserted into the terminal receiving cavity from the distal end of the insulating tube. The latching sleeve is received within the terminal receiving cavity when the latching sleeve is inserted into the terminal receiving cavity from the proximal end of the insulating tube to contact an insertion limiting surface of the insulating tube, preventing further insertion of the latching sleeve within the terminal receiving cavity. The latching sleeve includes at least one flexible latching member extending away from its proximal end, having a latching surface facing its proximal end. The latching surface of the spring latching member is moved to extend adjacent the latching surface of the contact terminal as the latching sleeve is inserted to contact the insertion limiting surface with the terminal member inserted within the terminal receiving cavity.

The contact terminal may include a plurality of the flexible contact members extending toward the proximal end of the contact terminal around a circular cavity disposed to receive the terminal pin, while the latching sleeve may include a plurality of the flexible latching members extending around a cavity for receiving the contact terminal. The insertion limiting surface may be a portion of the proximal end of the insulating tube, while the proximal end of the latching sleeve includes a flange engaging the insertion limiting surface.

In accordance with another aspect of the invention, an igniter cable includes a flexible portion having a wire including a conductor, an igniter connector at its distal end, and an input connector at its proximal end, with the input connector including a contact terminal, an insulating tube, and a latching sleeve, each as described above.

In accordance with yet another aspect of the invention, a method is provided for installing a connector at a proximal end of a cable. The method includes attaching a contact terminal to a proximal end of a conductor within the wire and inserting the terminal and wire subassembly into the distal end of a terminal receiving cavity within an insulating tube, with the terminal and wire subassembly being moved into a fully inserted position within the terminal receiving cavity. The method additionally includes inserting a latching sleeve, including at least one latching member extending toward a distal end of the latching sleeve, into the proximal end of the terminal receiving cavity, to a fully inserted position at which movement of the latching sleeve into the terminal receiving cavity is stopped by contact between the latching sleeve and an insertion limiting surface of the terminal receiving cavity, wherein, with the terminal and wire subassembly in its fully inserted position within the terminal receiving cavity, and with the latching sleeve in its fully inserted position within the terminal receiving cavity, a latching surface of the latching member, facing the proximal end of the latching member, moves to extend adjacent a latching surface of the contact terminal, facing the distal end of the latching member.

The terminal and wire assembly may be inserted into the terminal receiving cavity before or after the latching sleeve is inserted, or they may be inserted simultaneously from opposite ends of the terminal receiving cavity.

DETAILED DESCRIPTION OF THE INVENTION

Figure 1:
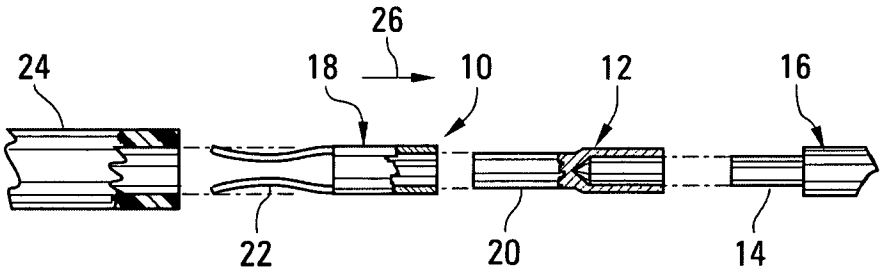
FIG. 1 PRIOR ART
FIG. 1 is an exploded, partly sectional, elevation of elements forming a first version of a conventional connector at an end of an igniter cable.
Figure 2:
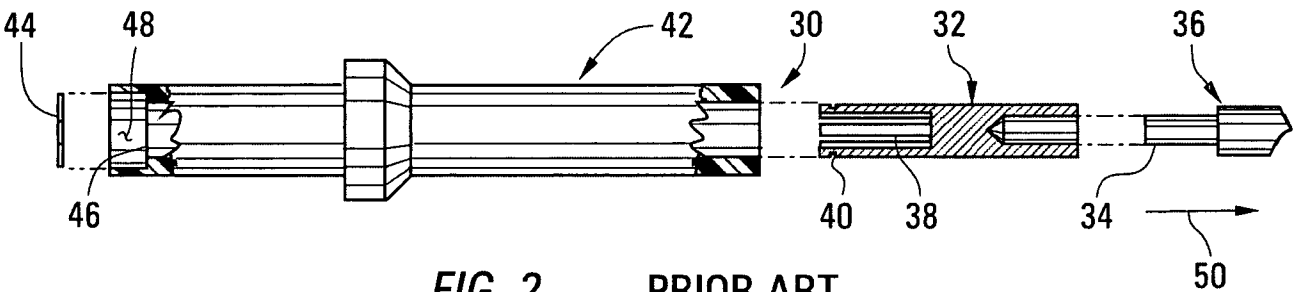
FIG. 2 PRIOR ART
FIG. 2 is an exploded, partly sectional, elevation of elements forming a second version of a conventional connector at an end of an igniter cable.
Figure 3:
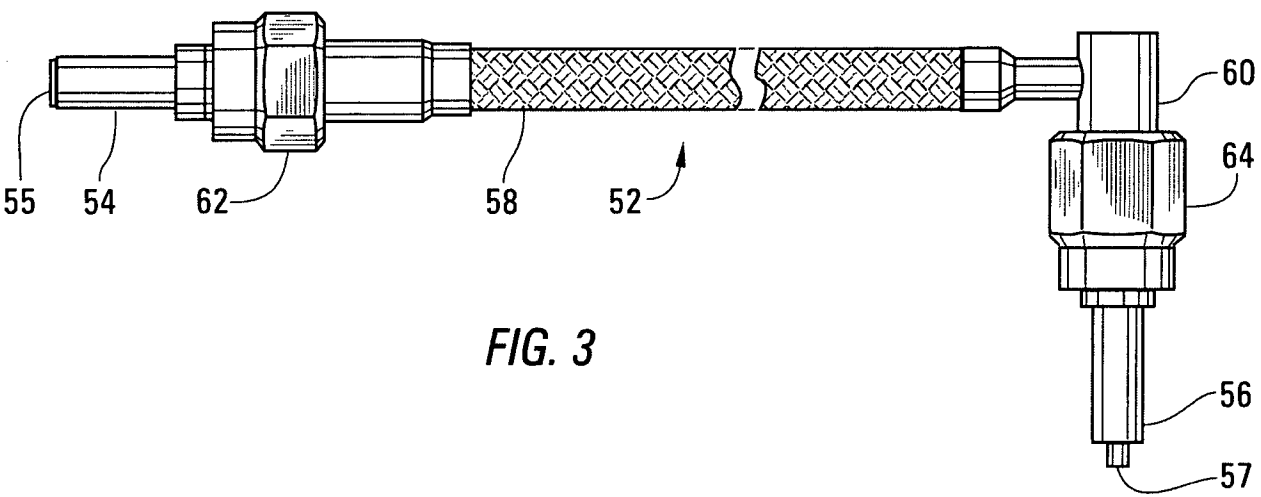
FIG. 3 is an elevation of an igniter cable built in accordance with the present invention.

FIG. 3 is an elevation of an igniter cable 52 built in accordance with the invention to include an input connector 54 at a proximal end 55 of the cable 52 for attachment of the cable 52 to a conventional high voltage terminal of an exciter. The input connector 54 is explained in detail below in reference to FIGS. 4–8. The igniter cable 52 additionally includes a plug connector 56 at a distal end 57 of the cable 52 for attachment to an igniter plug, and a flexible portion 58 extending between the input connector 54 and an elbow section 60 from which the plug connector 56 extends. The flexible portion 58 is shown as broken to indicate that the igniter cable 52 can be built in a number of different lengths. The igniter cable 52 also includes a nut 62 for attachment of the input connector 54 to the high voltage terminal of an exciter and a nut 64 for the attachment of the plug connector 56 to an igniter plug.

Figure 5:
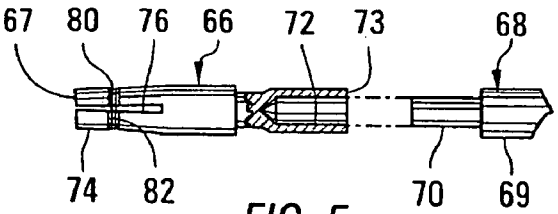
FIG. 5 is a partly sectional side elevation of the contact terminal of FIG. 4 in an exploded relationship with a wire in the igniter cable of FIG. 3.
Figure 4:
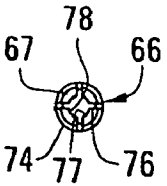
FIG. 4 is an end elevation of a contact terminal in an input connector within the igniter cable of FIG. 3.

The first steps in a process for installing the input connector 54, built in accordance with the present invention, within the cable 52 will now be discussed, with particular reference being made to FIGS. 4 and 5. FIG. 4 is an end elevation of a contact terminal 66 forming a part of the input connector 54, shown as viewed from its proximal end 67, while FIG. 5 is a partly sectional side elevation of the contact terminal 66 in an exploded relationship with a proximal end of the wire 68 within the igniter cable 52. The process for installing the input connector 54 begins with stripping insulation 69 from the wire 68 to expose an end of the conductor 70 therein, inserting the end of the conductor 70 into a wire receiving cavity 72 within the distal end 73 of the contact terminal 66, and crimping the contact terminal 66 onto the end of the conductor 70.

The contact terminal 66 includes a number of flexible contact members 74 configured to engage a rounded pin within the high voltage contact terminal of a conventional exciter. As shown in the example of the figures, the contact terminal 66 includes four flexible contact members 74, separated from one another by a cruciform slot configuration 76. Inner surfaces 78 of the spring members 74 are curved form a terminal receiving cavity 77 for accepting the rounded pin of the high voltage terminal of the exciter. The flexible contact members 74 may additionally be held together by approximately two turns of a helical spring 80 held within a slot 82 extending around the spring members 74.

Figure 6:
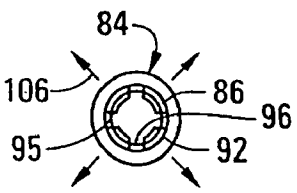
FIG. 6 is an end elevation of a latching sleeve in the input connector within the igniter cable of FIG. 3.
Figure 7:
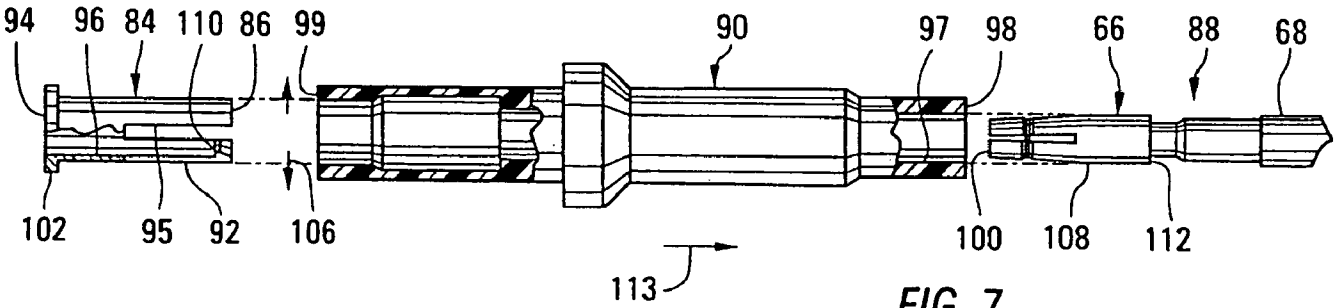
FIG. 7 is a partly sectional side elevation of the latching sleeve of FIG. 6, in an exploded relationship with a subassembly of the contact terminal of FIG. 4 and the wire of FIG. 5, and additionally in an exploded relationship with an insulating sleeve in the input connector within the igniter cable of FIG. 3.

Further steps in the installation of the input connector 54 on the cable 52 will now be discussed with reference being made to FIGS. 6 and 7. FIG. 6 is an end elevation of a latching sleeve 84 additionally forming part of the input connector 54, shown as viewed from its distal end 86. FIG. 7 is a partly sectional side elevation of the latching sleeve 84 in an exploded relationship with a terminal and wire subassembly 88 comprising the contact terminal 66 and the wire 68, upon which the contact terminal 66 has been crimped, and additionally in an exploded relationship with an insulating tube 90 forming part of the input connector 54.

The latching sleeve 84 includes a number of flexible latching members 92 extending away from the proximal end 94 of the latching sleeve 84. in the example of the figures, the latching sleeve 84 includes four flexible latching members 92, separated from one another by a cruciform slot configuration 95 to extend around a cavity 96 for receiving the contact terminal 66.

The process of installing the input connector 54 on the igniter cable continues as the terminal and wire subassembly 88 is inserted within a terminal receiving cavity 97 extending through the insulating tube 90 from its distal end 98 to its proximal end 99, with the terminal and wire subassembly 88 being inserted from the distal end 98 of the tube 90, into a fully inserted position, for example with the proximal end 100 of the contact terminal 66 extending slightly beyond the proximal end 99 of the insulating tube 90. Additionally, the latching sleeve 84 is inserted into the terminal receiving cavity 97 within the insulating tube 90, with the latching sleeve 84 inward from the proximal end 99 of the insulating tube 90. The latching sleeve 84 is inserted into a fully inserted position, in which further insertion movement is blocked by contact between a flange 102 at the proximal end 94 of the latching sleeve 84 and an insertion stopping surface at the proximal end 99 of the insulating tube 90. The latching arms 92 of the latching sleeve 84 are deflected radially outward, in the directions indicated by arrows 106, to pass over an outer surface 108 of the contact terminal 66. Either the terminal and wire subassembly 88 or the latching sleeve 84 may be inserted into the insulating tube 90 first, or they may be inserted simultaneously.

When both the terminal and wire subassembly 88 and the latching sleeve 84 have been fully inserted within the insulating tube 90, the latching arms 92 return radially inward, opposite the directions indicated by arrows 106, so that latching surfaces 110 of the latching members extend adjacent a latching surface 112 of the contact terminal 88, formed as an annular ledge, preventing inward movement of the contact terminal 88, in the direction of arrow 113, relative to the latching sleeve 84. The latching surfaces 110 face the proximal end 94 of the latching sleeve 84, while the latching surface 112 of the contact terminal 88 faces the distal end 73 of the contact terminal 88. Inward movement of the latching sleeve 84 within the insulating tube 90 is prevented by contact between a flange 102 of the latching sleeve 84 and the end 99 of the insulating tube 90. In this way, the latching sleeve 84 prevents movement of the contact terminal 66 in the direction of arrow 113 within the insulating tube 90.

Figure 8:
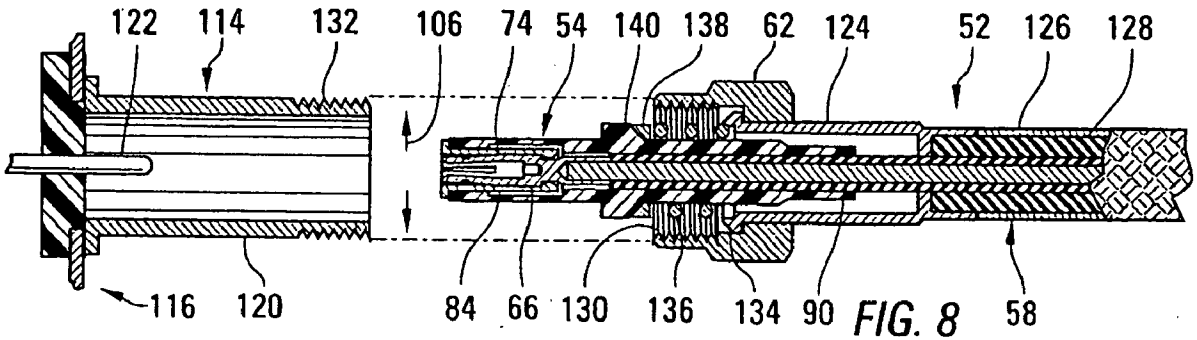
FIG. 8 is a cross-sectional side elevation of an end of the igniter cable of FIG. 3 in an exploded relationship with a high voltage output terminal of an exciter.

FIG. 8 is a cross-sectional side elevation of an end of the igniter cable 52, including the input connector 54, in an exploded relationship with a high voltage output terminal 114 of an exciter 116. The input connector 54 is attached to the output terminal 114 by moving the input connector 54 in an installation direction, opposite the direction of arrow 113, within an attachment tube 120 forming a portion of the output terminal 114, with the cantilever spring members 74 of the contact terminal 66 being deflected radially outward, in the directions of arrows 106, in contact with a rounded pin 122 of the output terminal 114, and with movement of the contact terminal 66 in the direction of arrow 113 within the insulating tube 90 being prevented as described above by the latching sleeve 84.

The igniter cable 52 also includes a ferrule 124, on which the nut 62 is movably mounted, which is attached to a flexible conduit 126 forming a part of the flexible cable portion 58. The flexible cable portion 58 also includes a flexible insulation tube 128 extending around the wire. As the input connector 54 is attached to the output terminal 114, the nut 62 is rotated into attachment with the attachment tube 120, with internal threads 130 of the nut 62 engaging external threads 132 of the tube 120. The connection between the connector 54 and the output terminal 114 is maintained in spite of vibration and forces that may be applied to the igniter cable 52, with the nut 62 being held against a flange 134 forming a portion of the ferrule 124, so that a helical compression spring 136 extending between the ferrule 124 and a ring 138 held against a flange 140 of the insulating tube 90 maintains the application of a force in the installation direction, opposite the direction of arrow 113, to the insulating tube 90.

While the invention has been described in terms of a preferred embodiment with some degree of particularity, it is understood that this description has been given only by way of example, and that many variations in the form and arrangement of parts may be achieved without departing from the spirit and scope of the invention, as defined in the appended claims.

What is claimed is:

1. A connector for attachment to an end of a cable, comprising:

a contact terminal including a wire receiving cavity at a distal end of the contact terminal for receiving an end of a conductor in a wire within the cable, at least one flexible contact member disposed to engage a terminal pin inserted into the contact terminal from a proximal end of the contact terminal, and a latching surface facing the distal end of the contact terminal;

an insulating tube including a terminal receiving cavity extending between proximal and distal ends of the insulating tube for receiving the contact terminal attached to the end of the conductor in the wire within the cable, with the contact terminal being inserted into the terminal receiving cavity from the distal end of the insulating tube; and a latching sleeve received within the terminal receiving cavity when the latching sleeve is inserted into the terminal receiving cavity from the proximal end of the insulating tube to contact an insertion limiting surface of the insulating tube, preventing further insertion of the latching sleeve within the terminal receiving cavity, wherein the latching sleeve includes at least one flexible latching member extending away from the proximal end of the latching sleeve, having a latching surface facing the proximal end of the latching sleeve, and wherein the latching surface of the spring latching member is moved to extend adjacent the latching surface of the contact terminal as the latching sleeve is inserted to contact the insertion limiting surface with the terminal member inserted within the terminal receiving cavity.

2. The connector of claim 1, wherein the contact terminal includes a plurality of the flexible contact members extending toward the proximal end of the contact terminal around a circular cavity disposed to receive the terminal pin.

3. The connector of claim 1, wherein the latching sleeve includes a plurality of the flexible latching members extending around a cavity for receiving the contact terminal.

4. The connector of claim 1, wherein the insertion limiting surface is a portion of the proximal end of the insulating tube; and the proximal end of the latching sleeve includes a flange engaging the insertion limiting surface.

5. The method of claim 1, wherein the insertion limiting surface is a portion of the proximal end of the insulating tube; and the proximal end of the latching sleeve includes a flange engaging the insertion limiting surface.

6. An igniter cable comprising a flexible portion including a wire having a conductor, an igniter connector at a distal end of the igniter cable, and an input connector at a proximal end of the igniter cable, wherein the input connector includes:

a contact terminal attached to an end of the wire at a distal end of the contact terminal, at least one flexible contact member disposed to engage a terminal pin inserted into the contact terminal from a proximal end of the contact terminal, and a latching surface facing the distal end of the contact terminal;

an insulating tube including a terminal receiving cavity extending between proximal and distal ends of the insulating tube, holding the contact terminal and a proximal end of the wire; and a latching sleeve held within a proximal end of the terminal receiving cavity in contact with an insertion limiting surface of the insulating tube, preventing further movement of the latching sleeve into the terminal receiving cavity, wherein the latching sleeve includes at least one flexible latching member extending away from the proximal end of the latching sleeve, having a latching surface facing the proximal end of the latching sleeve, and wherein the latching surface of the spring latching member is disposed to extend adjacent the latching surface of the contact terminal.

7. The igniter cable of claim 6, wherein the contact terminal includes a plurality of the flexible contact members extending toward the proximal end of the contact terminal around a circular cavity disposed to receive the terminal pin.

8. The igniter cable of claim 6, wherein the latching sleeve includes a plurality of the flexible latching members extending around a cavity for receiving the contact terminal.

9. The igniter cable of claim 6, wherein the insertion limiting surface is a portion of the proximal end of the insulating tube; and the proximal end of the latching sleeve includes a flange engaging the insertion limiting surface.

10. The igniter cable of claim 6, additionally comprising:

a ferrule extending over a portion of the input connector toward the proximal end of the igniter cable; and a nut, movably mounted on the ferrule, including threads for engaging a threaded portion of an exciter high voltage output terminal.

11. A method for installing a connector at a proximal end of a cable, wherein the method comprises:

attaching a contact terminal to a proximal end of a conductor within the igniter cable to form a terminal and wire subassembly;

inserting the terminal and wire subassembly into the distal end of a terminal receiving cavity within an insulating tube, with the terminal and wire subassembly being moved into a fully inserted position within the terminal receiving cavity; and inserting a latching sleeve, including at least one latching member extending toward a distal end of the latching sleeve, into the proximal end of the terminal receiving cavity, to a fully inserted position at which movement of the latching sleeve into the terminal receiving cavity is stopped by contact between the latching sleeve and an insertion limiting surface of the terminal receiving cavity, wherein, with the terminal and wire subassembly in its fully inserted position within the terminal receiving cavity, and with the latching sleeve in its fully inserted position within the terminal receiving cavity, a latching surface of the latching member, facing the proximal end of the latching member, moves to extend adjacent a latching surface of the contact terminal, facing the distal end of the latching member.

12. The method of claim 11, wherein the step of attaching a contact terminal to a proximal end of a conductor is preceded by stripping insulation from a wire within the igniter cable to expose the conductor.

13. The method of claim 11, wherein the contact terminal includes:

a wire receiving cavity at a distal end of the contact terminal in which the proximal end of a conductor within the igniter cable is attached; and at least one flexible contact member disposed to engage a terminal pin inserted into the contact terminal from a proximal end of the contact terminal.

14. The method of claim 11, wherein the contact terminal includes a plurality of the flexible contact members extending toward the proximal end of the contact terminal around a circular cavity disposed to receive the terminal pin.

15. The method of claim 11, wherein the latching sleeve includes a plurality of the flexible latching members extending around a cavity for receiving the contact terminal.

* * * * *